US005699438A

United States Patent [19]

Smith et al.

[11] Patent Number: 5,699,438

[45] Date of Patent: Dec. 16, 1997

[54] SPEAKER MOUNTING SYSTEM

[75] Inventors: Nels R. Smith; Kevin M. Burke; Peter W. La Belle, all of Holland, Mich.

[73] Assignee: Prince Corporation, Holland, Mich.

[21] Appl. No.: 519,132

[22] Filed: Aug. 24, 1995

[51] Int. Cl.[6] ..... H04R 25/00

[52] U.S. Cl. ..... 381/188; 381/86; 381/205; 181/141; 24/289; 403/348

[58] Field of Search ..... 381/24, 86, 87, 381/88, 89, 90, 152, 188, 189, 193, 205; 455/345, 350; 379/433, 428, 434; 248/27.1, 222.52; 403/348, 349; 24/289, 590; 181/141, 150, 171; 292/4, 5

[56] References Cited

U.S. PATENT DOCUMENTS

| | | | |
|---|---|---|---|
| 2,060,666 | 11/1936 | Ellmore | 381/205 |
| 2,272,688 | 2/1942 | Caltron | 248/27.1 |
| 3,017,217 | 1/1962 | Keating | 403/353 |
| 3,853,414 | 12/1974 | Hirano et al. | 403/349 |
| 4,125,339 | 11/1978 | Pittinger, Sr. et al. | 403/348 |
| 4,179,009 | 12/1979 | Birkner | 181/171 |
| 4,538,967 | 9/1985 | Furukawa | 403/349 |
| 4,653,708 | 3/1987 | Rich | 248/27.1 |
| 4,828,910 | 5/1989 | Haussling | 428/284 |
| 4,852,178 | 7/1989 | Inkman et al. | 381/205 |
| 4,853,966 | 8/1989 | Skrzycki | 381/188 |
| 4,997,059 | 3/1991 | See | 381/205 |
| 5,016,934 | 5/1991 | Pelz | 296/214 |
| 5,273,243 | 12/1993 | Abdallah et al. | 248/27.1 |
| 5,274,701 | 12/1993 | Schmidt et al. | 381/188 |

FOREIGN PATENT DOCUMENTS

| | | |
|---|---|---|
| 993439 | 10/1951 | France . |
| 2527404 | 6/1975 | Germany . |

*Primary Examiner*—Huyen D. Le

*Attorney, Agent, or Firm*—Price, Heneveld, Cooper, DeWitt & Litton

[57] ABSTRACT

A combined speaker and locking member extend through an aperture in a vehicle headliner to mount the speaker to the headliner. The locking member includes offset locking flanges which engage the upper surface of the headliner when installed, and the speaker includes locking tabs extending through the slots in the headliner for engaging the lower surface of the headliner. The speaker further includes a pair of locking slots which receive the offset locking flanges of the locking member such that the locking member and speaker move together during installation. The speaker is locked into position by a raised locking surface formed on the side of the locking flanges facing the headliner to extend into the opposed slots of the headliner when the speaker is rotated with its tabs positioned on the opposite side of the headliner.

24 Claims, 3 Drawing Sheets

SPEAKER MOUNTING SYSTEM

BACKGROUND OF THE INVENTION

The present invention relates to a speaker mounting system for a vehicle and particularly one for mounting a speaker directly to a flexible panel, such as a headliner.

In most vehicles, the audio system includes a plurality of speakers distributed throughout the interior of the vehicle to provide a full-range, stereophonic sound system. Speakers are typically placed in the instrument panel, door panels, the rear storage ledge and sometimes in consoles. Typically, speakers are mounted directly to sheet metal supporting structures of the vehicle utilizing fastening screws, rivets or other fasteners. Recently, it was discovered that relatively small speakers mounted directly to the vehicle headliner at appropriate locations and coupled to suitable sources of audio signals, such as amplifiers, delay circuits and a signal source, produces remarkable reproduction of the audio information providing dimensional sound imaging and depth not possible with speaker locations in the lower portions of the vehicle interior as in the past. Such an audio system is described in U.S. patent application Ser. No. 08/283,680, entitled VEHICLE AUDIO SYSTEM, filed on Aug. 1, 1994, and assigned to the present assignee. In such system, the speakers were attached either using a clamping plate and conventional fasteners or, in one embodiment, utilizing cyanoacrylate adhesives. Although such mounting systems proved adequate, the utilization of conventional fasteners and a clamping ring is somewhat labor intensive and costly, and the utilization of the cyanoacrylate adhesives also is costly and involves a somewhat messy process.

The headliner itself may comprise a flexible molded composite of compressed, resin impregnated, fibrous materials covered by a suitable foam backed upholstery material, such as that commercially sold under the trademark Acousti GP Cor® by the assignee of the present invention. One such headliner material is disclosed in U.S. Pat. No. 4,828,910, although other headliner material or vehicle panel construction can be employed as long as they are somewhat flexible. This headliner material typically has a relatively porous upper surface facing the sheet metal roof of the vehicle which may be covered by a scrim material and a fabric surface facing the interior of the vehicle when the headliner is installed. The thickness of the headliner materials varies depending upon the location within the headliner, although the material is relatively thin and flexible and/or compressible in all areas.

SUMMARY OF THE INVENTION

The mounting system of the present invention takes advantage of the characteristics of the relative thin, flexible and compressible acoustical headliner material employed in modem vehicles and the discovery of the mounting of speakers directly to such headliner material for providing an improved sound system.

In a preferred embodiment of the invention, the headliner includes a keyed aperture having a circular opening for a speaker, which opening includes a pair of opposed slots for receiving locking tabs extending from a mounting flange of a speaker. A locking member is positioned between the speaker and headliner and is generally circular to extend through the aperture in the headliner. It includes offset locking flanges which engage the upper surface of the headliner when installed with the locking tabs of the speaker flange extending through the slots of the headliner and, when rotated, engage the under surface of the headliner in the area between the foam-backed upholstery material and the headliner substrate. In a preferred embodiment of the invention, the speaker flange further includes a pair of locking slots which receive the offset locking flanges of the locking member such that the locking member and speaker move together during installation. In a further embodiment of the invention, the speaker is locked into position by a raised locking surface formed on the downwardly facing second side of the locking flanges of the locking member to extend into the opposed slots of the headliner when the speaker is rotated with its tabs positioned on the opposite side of the headliner substrate.

During installation, the headliner is deformed slightly to allow the tabs of the speaker flange to extend through the opposed slots with the locking member interlocked to the speaker with its locking flanges extending on the opposite side of the headliner substrate. The speaker is subsequently rotated until the raised locking surfaces of the offset locking flanges snap-lock into the opposed slots with the offset locking flanges circumscribing an arc greater than the arc circumscribed by the opposed slots in the headliner to compressively mount the speaker flange to the headliner substrate with the locking member and speaker concealed, in the preferred embodiment, behind the headliner upholstery material.

Such a mounting arrangement takes advantage of the flexibility and compressibility of the acoustical headliner material typically employed in modem vehicle designs and allows the mounting of the speaker to the headliner utilizing the speaker itself and a locking member without additional fasteners or manufacturing steps. This both reduces the cost of the mounting system as well as provides a system which takes advantage of the properties of the headliner material. These and other features objects and advantages of the present invention will become apparent upon reading the following description thereof together with reference to the accompanying drawings.

DETAILED DESCRIPTION OF THE PREFERRED EMBODIMENT

Figure 1:
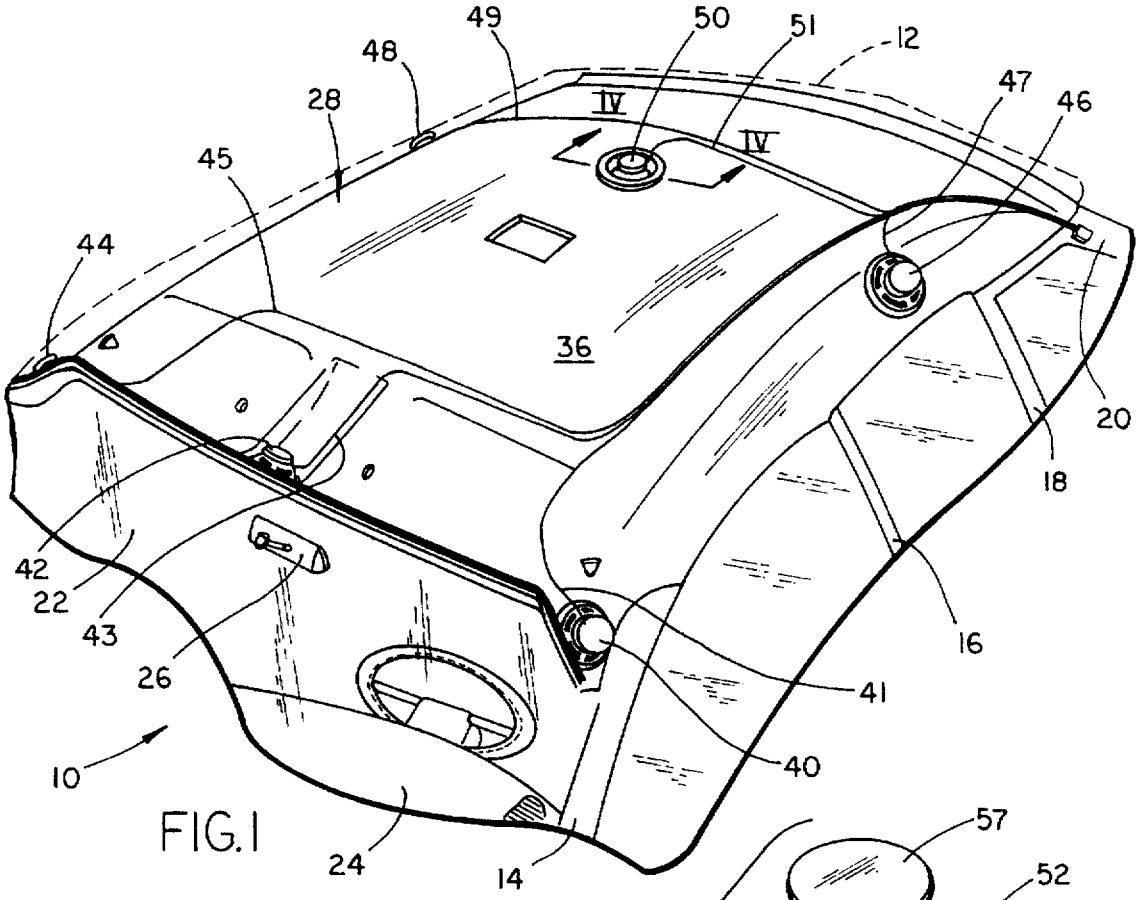
FIG. 1 is a fragmentary, perspective view of the roof area of an automobile looking downwardly from above with the roof shown in phantom form to show a headliner with a speaker system mounted according to the present invention.
Figure 4:
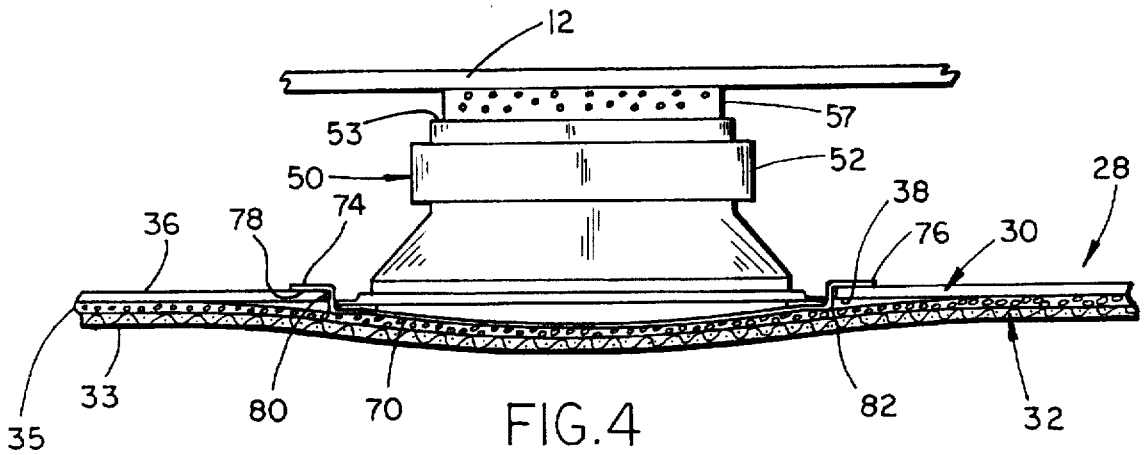
FIG. 4 is a cross-sectional view of the speaker assembly shown in FIG. 3, taken along section line IV—IV of FIG. 3.
Figure 5:
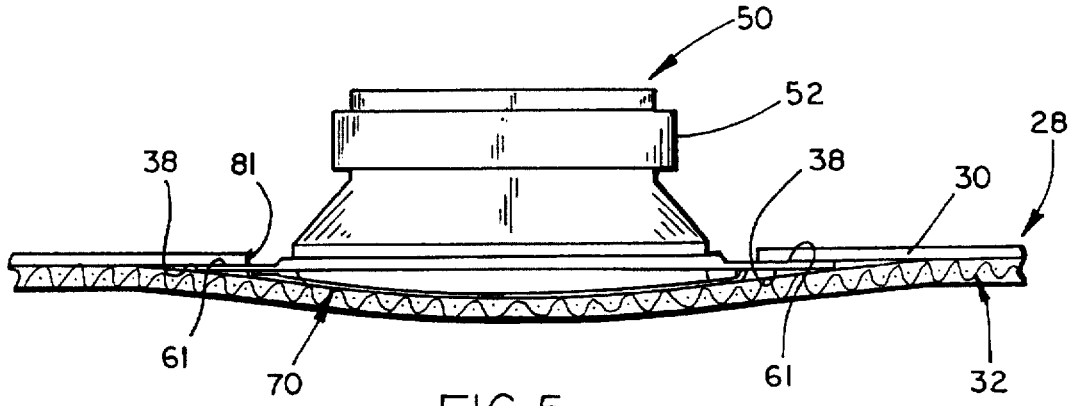
FIG. 5 is a cross-sectional view of the speaker mounting system taken along section lines V—V of FIG. 3.

Referring initially to FIG. 1, there is shown a vehicle 10, such as an automobile, which includes a roof 12 (shown in phantom), which is conventionally supported by a plurality of support pillars 14, 16, 18 and 20 to the body of the vehicle. A windshield 22 extends from the area in front of the instrument panel 24 to the forward edge of the roof 12 and may include a rearview mirror assembly 26 mounted thereto in a conventional manner. The vehicle includes an integrally molded headliner 28 which, as best seen in FIGS. 4 and 5, includes a substrate 30 and an overlying upholstery material 32 which is a composite of an upholstery fabric surface 33 facing the interior of the vehicle when the headliner 28 is installed and a foam backing material 35 which is integrally formed with the fabric 33 to form the composite upholstery layer 32. The substrate 30 may be a composite of compressed, fibrous material impregnated with a suitable resin and which may include a scrim surface layer on its first or inner surface 36 facing the inside of the roof 12 when the headliner is installed. The second or lower surface 38 of the headliner substrate 30, as well as surface 36, are relatively porous and the thickness of the substrate 30 will vary depending upon the location on the headliner 12. The headliner substrate, however, remains relatively flexible, and either thin and somewhat dense or thicker and somewhat compressible throughout the area of the headliner. Such headliner material is described in greater detail in the above identified U.S. Pat. No. 4,828,910, the disclosure of which is incorporated herein by reference. The speakers are mounted to the relatively thin (about 0.125–0.5 inches) flexible areas of the headliner.

The speaker system embodying the present invention includes a plurality of speakers located at a variety of locations. As shown in FIG. 1, a first speaker 40 is mounted in the left front comer of the headliner 28, a center front speaker 42 is mounted to the headliner directly above the rearview mirror 26 and speaker 44 is mounted to the fight front corner of the headliner. In the rear section of the headliner, left and right rear speakers 46, 48 are mounted to opposite sides of the headliner, while a rear center speaker 50 is mounted to the center of the headliner toward the rear. In other embodiments of the invention, a fewer or greater number of speakers may be included to provide the desired sound staging and acoustical effect for a given vehicle. Each of the speakers is of a relatively small size, from about 3 to 5 inches in diameter, and are coupled to the vehicle's audio system utilizing suitable pairs of conductors such as 41, 43, 45, 47, 49 and 51. The vehicle audio system may include a suitable sound source, amplifiers, equalizers, delay circuits and the like, as disclosed in the above identified patent application Ser. No. 08/283,680, the disclosure of which is incorporated herein by reference. Each of the speakers shown in FIG. 1 or in alternative embodiments of the speaker placement are mounted utilizing the unique mounting system of the present invention which relies in part upon the flexible nature of the acoustical headliner material.

Figure 2:
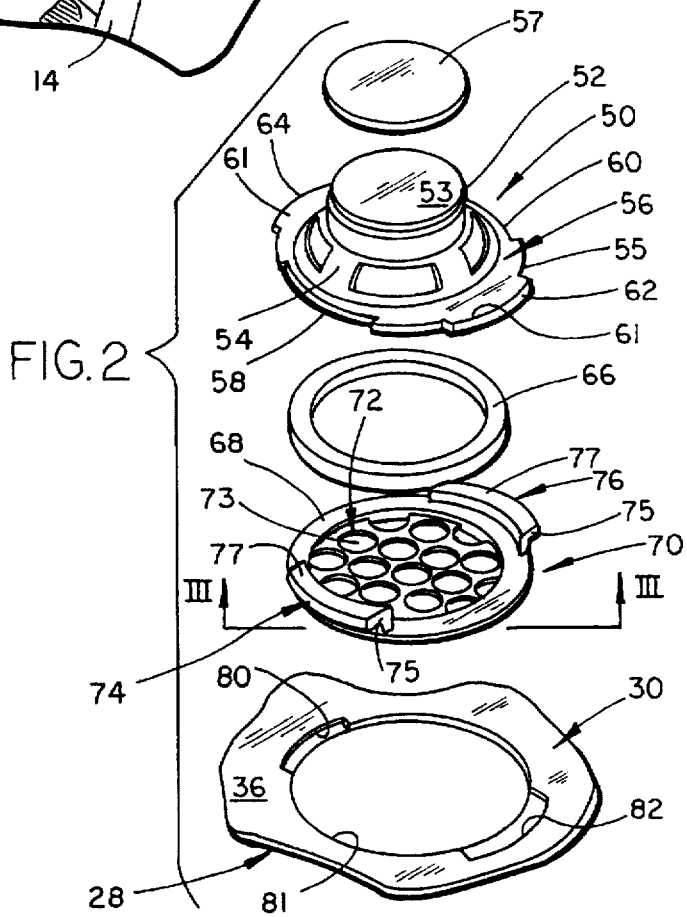
FIG. 2 is an exploded, fragmentary, perspective view of a speaker mounting system embodying the present invention.

Turning now to FIG. 2, there is shown an exploded view of the mounting of speaker 50 of FIG. 1, which speaker includes a permanent magnet 52, a frame typically referred to as a basket 54 to which the permanent magnet is mounted, and a mounting flange 56 having a pair of opposed mounting slots 58, 60. Each slot circumscribes an arc of approximately 30° and are located in opposed relationship across the generally circular flange 56 of the speaker 50. The flange 56 further includes a pair of opposed, outwardly extending arcuate locking tabs 62, 64, which project outwardly from the periphery 55 of rim 56 a distance of approximately 0.5 inch and which circumscribe a narrower arc of approximately 15°. Flange 56 is integral with basket 54 in the preferred embodiment, although it can be a separately mounted flange with a suitable circular opening to which the speaker cone is flexibly mounted at its periphery as is conventional. The speaker further includes a voice coil interacting with the magnet 52 in a conventional manner to provide a sound transducer for the conversion of electrical energy to physical movement for reproducing the audio information supplied to the voice coil through the pairs of conductors coupled to the speakers. These details are not shown in connection with the mounting system of the present invention.

The speaker magnet 52 has a generally circular upper surface 53 to which a compressible foam disk 57 can be attached for providing an interface between the speaker 50 and the sheet metal roof 12 of the vehicle as seen in FIG. 4. Thus, the magnetic properties of the speakers themselves can be employed to assist in holding the headliner to the vehicle roof with the magnet being of sufficient strength such that an attractive force is provided. Flange 56 includes a central circular opening having a diameter substantially equal to or somewhat greater than that of the speaker cone and which is surrounded by a foam compression ring-shaped gasket 66. Gasket 66, in turn, engages the upper annular surface 68 of a locking member 70.

Locking member 70 can comprise a generally ring-shaped structure, although the central area 72 may include an integrally formed grill having a plurality of apertures 73 with the grill protecting the speaker cone, although the speaker in the preferred embodiment will be covered by the upholstery material 32, as seen in FIGS. 4 and 5. Locking member 70 can be made of a suitable polymeric material or stamped from sheet metal if desired which is suitably treated for use in the automotive environment. Locking member 70 includes a pair of offset locking flanges 74, 76, each of which includes a generally upwardly extending arcuate leg 75 and an outwardly extending arcuate flange 77 having a first or upper surface and a second or lower surface 78 (FIG. 4) which, when installed, engages the first or upper surface 36 of the headliner substrate 30. The offset locking flanges 74, 76 circumscribe an arc of approximately 30°, such that the locking slots 58, 60 of speaker flange 56 can receive the offset locking flanges to interlock the locking member 70 with the speaker as described in detail below.

The second or lower surface 78 of each of the locking flanges 74, 76 further include raised arcuate locking lands 79 (FIGS. 3, 7 and 8) which circumscribe an arc of approximately 15°, such that, once installed, they extend through opposed locking slots 80, 82 formed in the headliner substrate 30 for locking the speaker assembly against rotation and in place. The locking member 70 is rotationally interlocked with the speaker by the legs 75 of flanges 74, 76 of the locking member extending into the slots 58, 60 of the speaker flange 56. In this position, the gasket 66 positions the locking tabs 62, 64 of the speaker flange 56 in relationship to the locking flanges 74, 76 of locking member 60 such that the tabs 62, 64 of the speaker flange can be extended through slots 80, 82 of the headliner and engage, as seen in FIG. 5, the second or lower surface 38 of the headliner substrate 30 with the second or lower surfaces 78 of locking flanges 74, 76 engaging the first or upper surface 36 of the headliner substrate 30, as seen in FIG. 4. The gasket 66 and/or legs 75 are dimensioned to provide this relative relationship of the two mounting surfaces which are spaced to compressively grip the headliner substrate 30.

Figure 3:
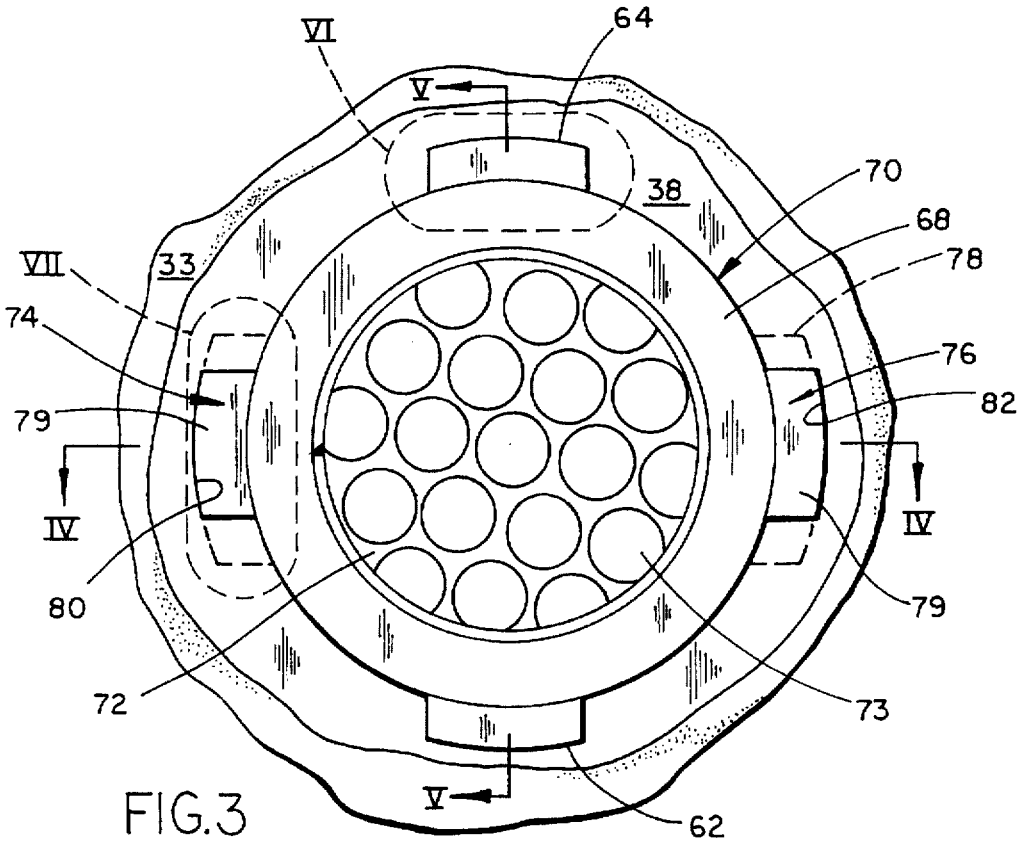
FIG. 3 is a bottom, plan view of one of the speakers shown in FIG. 1 looking upwardly from the interior of the vehicle and shown with the upholstery fabric of the headliner broken away.
Figure 6:
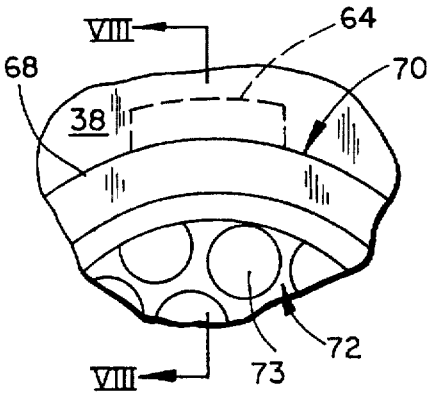
FIG. 6 is a top plan view of the encircled area VI of FIG. 3.
Figure 7:
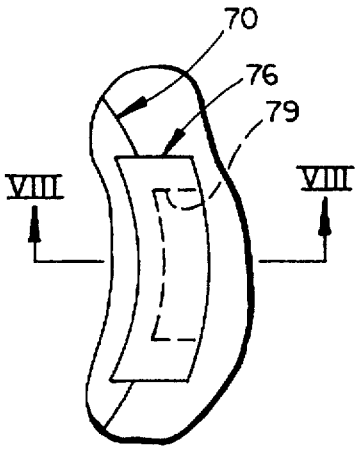
FIG. 7 is a top, plan view of the encircled area VII of FIG. 3.
Figure 8:
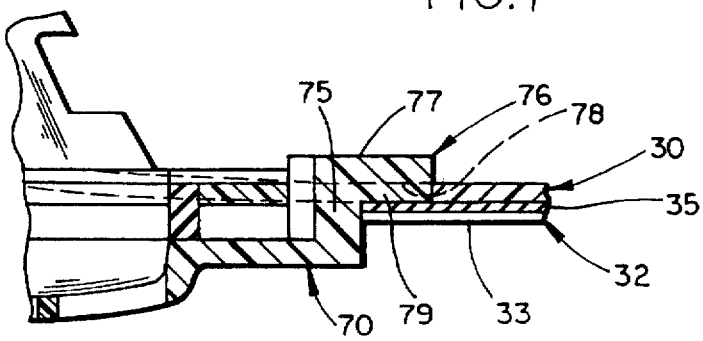
FIG. 8 is an enlarged, fragmentary, cross-sectional view taken along section lines VIII—VIII of FIG. 7.

For installation, the speaker is mounted to the locking member 70 first with flanges 74, 76 engaging slots 58, 60. Next, the tabs 62, 64 of the speaker flanges are aligned with slots 82, 80 of the headliner substrate 30 and are pressed downwardly flexing the flexible headliner substrate material sufficiently to allow tabs 62, 64 to pass through speaker mounting aperture 81 of the headliner substrate and clear the surface 38 of the headliner substrate in the area adjacent the aperture 81. The flexible nature of the headliner substrate 30 allows deflection of the headliner around the periphery of mounting aperture 81 sufficient to allow tabs 62, 64 to clear the lower surface 38 of the headliner substrate at which time the speaker and locking member or ring 70 are rotated approximately 90° until the raised arcuate lands 79 of the locking flanges of member 70 snap into and interlock with locking slots 80, 82 thereby locking the speaker in position with respect to the headliner. In this position, as best seen in FIG. 5, the first or upper surface 61 of each of the tabs 62, 64 engage the second surface 38 of the headliner substrate 30 in an area around the periphery of opening 81, approximately 90° from the entry slots 80, 82. It is noted that the upholstery material 32 preferably is not bonded to the substrate 30 in the annular space surrounding aperture 81 such that clearance is provided for tabs 62, 64 between the upholstery material 32 and the substrate 30. In this mounted position also, the offset locking flanges 74, 76 of the locking member 70 extend over the upper surface 36 of substrate 30 with the surfaces 78 of the locking flanges engaging surface 36 and arcuate lands 79 extending within slots 80, 82, as seen in FIGS. 3, 7 and 8, to interlock the speaker assembly to the headliner.

Thus, with the system of the present invention, a locking member and speaker are interlocked and the combination pressed through a keyed aperture in the substrate, rotated 90° and snap-locked to the substrate without additional fastening means or manufacturing steps. The resultant structure provides a secure, raffle-free mounting of the speaker assembly to the substrate and advantageously utilizes the flexible nature of the substrate to provide the secure mounting of the assembly.

It will become apparent to those skilled in the art that various modifications to the preferred embodiment of the invention as described herein can be made without departing from the spirit and scope of the invention as defined by the appended claims.

The embodiments of the invention in which an exclusive property or privilege is claimed are defined as follows.

What is claimed is:

1. A combined speaker and locking member for mounting a speaker to a substrate having a keyed aperture with opposed mounting slots comprising:

said speaker including a frame with a pair of opposed outwardly extending tabs and a pair of opposed inwardly extending locking slots; and a locking member shaped to mateably engage said frame, said locking member having a pair of opposed locking flanges extending outwardly from a peripheral edge of said locking member, wherein each of said flanges includes a leg extending orthogonal to the plane of said member to offset said flanges in a direction toward said speaker such that said flanges extend through said locking slots in said frame and are spaced from said tabs of said frame such that said flanges engage a first surface of the substrate and said tabs engage an opposite second surface of the substrate when said tabs are extended through the mounting slots of the substrate and rotated.

2. The apparatus as defined in claim 1 wherein said locking flanges have a first surface and an opposite second surface and said second surface of said locking flanges engage said first surface of the substrate.

3. The apparatus as defined in claim 2 wherein said tabs and locking slots of said frame are arcuate segments.

4. The apparatus as defined in claim 3 wherein said legs and locking flanges of said locking member are arcuate segments and said legs circumscribe an arc substantially equal to the arc of said locking slots to interlock said speaker and said locking member.

5. The apparatus as defined in claim 4 wherein said second surface of each of said locking flanges further include a raised arcuate land circumscribing an arc substantially equal to the arc circumscribed by said tabs of said frame.

6. The apparatus as defined in claim 5 wherein said locking member integrally includes a speaker grill.

7. The apparatus as defined in claim 6 wherein the arc circumscribed by said locking flanges is about twice the arc circumscribed by said tabs of said frame.

8. The apparatus as defined in claim 7 wherein said speaker includes a basket and said frame of said speaker is integral with said basket.

9. A speaker mounting system comprising:

a relatively thin flexible substrate including first and second surfaces and a keyed aperture including mounting slots formed therein;

a speaker including a frame with a pair of opposed outwardly extending tabs and a pair of opposed inwardly extending locking slots spaced from said tabs; and a locking member shaped to mateably engage said frame, said locking member having a pair of opposed locking flanges, each including a leg extending orthogonal to the plane of said locking member to offset said flanges in a direction toward said speaker such that said flanges extend through said locking slots in said frame and are spaced from said tabs of said frame such that said flanges engage said first surface of said substrate and said tabs engage said second surface of said substrate when said tabs are extended through the mounting slots of said substrate and rotated.

10. The apparatus as defined in claim 9 wherein said locking flanges have a first surface and an opposite second surface and said second surface of said locking flanges engage said first surface of said substrate.

11. The apparatus as defined in claim 10 wherein said tabs and locking slots of said frame are arcuate segments.

12. The apparatus as defined in claim 11 wherein said legs and locking flanges of said locking member are arcuate segments and said legs circumscribe an arc substantially equal to the arc of said locking slots to interlock said speaker and said locking member.

13. The apparatus as defined in claim 12 wherein said second surface of each of said locking flanges further include a raised arcuate land circumscribing an arc substantially equal to the arc circumscribed by said tabs of said frame.

14. The apparatus as defined in claim 13 and further including an upholstery material attached to said second surface of said substrate and covering said keyed aperture.

15. The apparatus as defined in claim 14 wherein the arc circumscribed by said locking flanges is about twice the arc circumscribed by said tabs of said frame.

16. The apparatus as defined in claim 15 wherein said speaker includes a basket and said mounting frame of said speaker is integral with said basket.

17. A vehicle headliner and speaker system comprising:

a headliner including a relatively thin flexible substrate having first and second surfaces and covered by an upholstery material, said substrate including a plurality of apertures including mounting slots for mounting a speaker to said substrate in each aperture to be concealed by said upholstery material;

a speaker including a frame with a pair of opposed outwardly extending tabs and a pair of opposed inwardly extending locking slots; and a locking member having a pair of opposed locking flanges, wherein each of said flanges includes a leg extending orthogonal to the plane of said member to offset said flanges in a direction toward said speaker such that said flanges extend through said locking slots in said frame and are spaced from said tabs of said frame such that said flanges engage said first surface of said substrate and said tabs engage said second surface of said substrate when said tabs are extended through the mounting slots of said substrate and rotated.

18. The apparatus as defined in claim 17 wherein said locking flanges have a first surface and an opposite second surface and said second surface of said locking flanges engage said first surface of said substrate.

19. The apparatus as defined in claim 18 wherein said tabs and locking slots of said frame are arcuate segments.

20. The apparatus as defined in claim 19 wherein said legs and locking flanges of said locking member are arcuate segments and said legs circumscribe an arc substantially equal to the arc of said locking slots to interlock said speaker and said locking member.

21. The apparatus as defined in claim 20 wherein said second surface of each of said locking flanges further include a raised arcuate land circumscribing an arc substantially equal to the arc circumscribed by said tabs of said frame.

22. The apparatus as defined in claim 21 wherein said locking member integrally includes a speaker grill.

23. The apparatus as defined in claim 22 wherein the arc circumscribed by said locking flanges is about twice the arc circumscribed by said tabs of said frame.

24. The apparatus as defined in claim 17 and further including a compressible gasket positioned between said frame and said locking member.

* * * * *

UNITED STATES PATENT AND TRADEMARK OFFICE

CERTIFICATE OF CORRECTION

PATENT NO. : 5,699,438
DATED : December 16, 1997
INVENTOR(S) : Smith et al.

It is certified that error appears in the above-identified patent and that said Letters Patent is hereby corrected as shown below:

Column 1, line 54;
"modem" should be --modern--.

Column 2, line 28;
"modem" should be --modern--.

Column 3, line 31;
"comer" should be --corner--.

Column 3, line 33;
"fight" should be --right--.

Column 5, line 32;
"raffle-free" should be --rattle-free--.

Signed and Sealed this

Twenty-first Day of April, 1998

Bruce Lehman

*Attest:*

BRUCE LEHMAN

*Attesting Officer*

*Commissioner of Patents and Trademarks*